US007079451B2

(12) United States Patent
Okeya

(10) Patent No.: US 7,079,451 B2
(45) Date of Patent: Jul. 18, 2006

(54) TIME MEASUREMENT DEVICE AND METHOD OF CONTROLLING THE TIME MEASUREMENT DEVICE

(75) Inventor: Makoto Okeya, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 96 days.

(21) Appl. No.: 10/460,621

(22) Filed: Jun. 11, 2003

(65) Prior Publication Data

US 2004/0037172 A1 Feb. 26, 2004

(30) Foreign Application Priority Data

Jun. 12, 2002 (JP) ..... 2002-171468

(51) Int. Cl.
*G04C 11/02* (2006.01)

(52) U.S. Cl. ..... 368/47

(58) Field of Classification Search ..... 368/47–52, 368/64, 66, 203–204; 320/100–167; 713/320–322
See application file for complete search history.

(56) References Cited

U.S. PATENT DOCUMENTS

| | | | | | |
|---|---|---|---|---|---|
| 5,297,120 | A | * | 3/1994 | Yuzuki et al. | 368/47 |
| 5,798,985 | A | * | 8/1998 | Nakajima | 368/64 |
| 5,926,404 | A | * | 7/1999 | Zeller et al. | 713/321 |
| 5,943,301 | A | * | 8/1999 | Igarashi | 368/204 |
| 6,061,304 | A | * | 5/2000 | Nagata et al. | 368/66 |
| 6,643,223 | B1 | * | 11/2003 | Fujisawa | 368/204 |

FOREIGN PATENT DOCUMENTS

| | | |
|---|---|---|
| DE | 196 00 245 A | 7/1997 |
| EP | 0657793 | 6/1995 |
| EP | 0935178 | 8/1999 |
| EP | 1126340 | 8/2001 |
| EP | 1326146 | 7/2003 |
| GB | 2 316 517 A | 2/1998 |
| JP | 10-332849 | 12/1998 |
| JP | 11-223684 | 8/1999 |
| JP | 2001-166076 | 6/2001 |
| JP | 2001-296379 | 10/2001 |
| JP | 2002-189586 | 5/2002 |
| JP | 2003-130973 | 5/2003 |
| WO | 02/14959 A | 2/2002 |

* cited by examiner

*Primary Examiner*—Kamand Cuneo
*Assistant Examiner*—Thanh S. Phan
(74) *Attorney, Agent, or Firm*—Rosalio Haro

(57) ABSTRACT

A time measurement device includes a power generator 2, secondary power source 31, current time counters 922 and 932, receiver circuit 42 for receiving a time standard radio wave, time display means 5 for displaying the current time, power detector 83 for outputting a power detection signal when the power generator 2 is in a power generating state or when a voltage stored in the secondary power source 31 is at a predetermined voltage value, operation mode switcher 874 switching, in response to the power detection signal, between a power saving mode in which time display is suspended and a standard mode in which time display is not suspended. The operation mode switcher 874 causes the time display means 5 to display the current time based on the time information counted by the time counters 922 and 932 and the time information received by the receiver circuit in response to the device being switched from the power saving mode to the standard mode.

24 Claims, 8 Drawing Sheets

TIME MEASUREMENT DEVICE AND METHOD OF CONTROLLING THE TIME MEASUREMENT DEVICE

BACKGROUND OF THE INVENTION

1. Field of the Invention

The present invention relates to a time measurement device and a method for controlling the time measurement device. Particularly, the present invention relates to a time measurement device having a function of power saving and a function of receiving a radio wave bearing time information, and a method for controlling the time measurement device.

2. Description of the Related Art

A radio wave corrected watch having a power saving function is known as a time measurement device which has the function of saving power and the function of receiving a radio wave bearing time information. Japanese Unexamined Patent Application Publication No.11-223684 discloses such a radio wave corrected watch.

The radio wave corrected watch includes a current time counter for counting current time, time display means for displaying current time of the current time counter, receiving means for receiving a radio wave bearing time information, a power generator, a secondary battery storing power generated by the power generator, a voltage detector circuit for detecting a voltage from the secondary battery, and operation mode switching means for switching the operation mode of the time display means and a receiver circuit in response to the value of the detected voltage from the voltage detector circuit.

A long-wave time standard radio wave may be used as the radio wave bearing time information.

The power generator used for the device may be based on one that converts the force of a rotating weight into electrical power, one that performs photovoltaic generation, one that performs thermal generation using temperature differences, etc.

The radio wave corrected watch in the above arrangement works in a standard mode when the magnitude of the voltage detected by the voltage detector circuit is equal to or greater than a predetermined voltage magnitude. Specifically in the standard mode, the current time counted by the current time counter is displayed on the time display means. The receiving means receives the time information at predetermined time intervals. The current time of the current time counter is corrected in accordance with the received time information, and the time displayed on the time display means is also corrected.

When the voltage detected by the voltage detector circuit is lower than the predetermined voltage, the radio wave corrected watch works in a power saving mode. Specifically in the power saving mode, the supply of power to the current time counter, time display means, and receiving means is suspended. The power required to count the current time, display the time, and receive the time information is saved.

When the voltage detected by the voltage detector circuit rises above the predetermined voltage again, the device is switched from the power saving mode to the standard mode. The receiving means then receives the time information.

The time display means displays the current time based on the received time information.

When the voltage detected by the voltage detector circuit is lower than the predetermined voltage in this arrangement, power can be saved because the time is not displayed and the time information is not received.

When the magnitude of the voltage detected by the voltage detector circuit grows to be equal to, or greater than, the predetermined voltage again, the receiver receives the time information, and the current time in the current time counter is corrected accordingly. When the watch returns to the standard mode from the power saving mode, precise time based on the received time information is displayed.

There may be a case where the receiving means fails to receive the time information when the watch returns to the standard mode from the power saving mode. For example, if the radio wave corrected watch is in a building, the long-wave time standard radio wave may be blocked by the building walls and may fail to reach the watch's receiving means. As a second example, if a source of magnetic field is present surrounding the radio wave corrected watch, the long-wave time standard radio wave may be distorted by magnetic noise, and the watch may not be able to receive precise time information.

There is no mention in the above-quoted disclosure of the case in which the reception of the time information is unsuccessful, and the watch fails to switch to the standard mode from the power saving mode in this case. To know the current time, the user must wait until the time information is successfully received. This is quite an inconvenience.

The power saving function is required by not only a time measurement device having a power generator, but also a time measurement device driven by a primary battery. In particular, the radio wave corrected, watch which consumes a lot of power to receive the time information, requires a battery having longer service life.

OBJECTS OF THE INVENTION

It is an object of the present invention to overcome the drawback of the conventional art, and to provide a time measurement device and a method of controlling the time measurement device which has a function of saving power and a function of receiving a radio wave bearing time information, and quickly displaying precise current time information.

SUMMARY OF THE INVENTION

A time measurement device according to the present invention has power generating means that generates power in response to energy coming in from the outside, power storage means for storing the power from the power generating means, current time information storage means for counting (i.e. tracking) the current time, receiving means for receiving a radio wave bearing time information, and time display means for displaying the current time. The preferred embodiment also includes power detecting means that outputs a power detection signal when the power detecting means detects that the power generating means is in an active power generating state or detects a condition wherein the voltage potential stored in the power storage means is at a predetermined voltage, and includes operation mode switching means that switches, in response to the power detection signal output from the power detecting means, between a power saving mode in which the time display means is maintained in a suspended state and a standard mode in which the time display means is maintained in an active state. The operation mode switching means causes the time display means to display the current time selectively based on the time information counted by the current time information storage means and/or on the time information received by the receiving means when the device is switched from the power saving mode to the standard mode.

In the above arrangement, the power generated by the power generating means is stored in the power storage means, and the time measurement device is operated by the power stored in the power storage means. The power generating means may be of the type that converts the force of a rotating weight (i.e. its mechanical energy) into power (i.e. electrical power), of the type that creates electrical power from thermal generation using temperature differences, of the type that implements photovoltaic generation, etc.

The power storage means may be charged by an external source.

The current time information storage means counts clock pulses of a predetermined frequency, and thereby successively updates the current time.

The operation mode switching means sets the operation mode to the standard mode in which the time display means is an active state, in response to the power detection signal output from the power detecting means. As stated above, the power detecting means outputs the power detection signal when it detects that the power generating means is in an active power generating state, such as for example, when generating electrical power from the kinetic energy of a rotating weight, or when the magnitude of the voltage stored in the power storage means is equal to or greater than the predetermined voltage magnitude. During the standard mode, the current time, as counted by the current time information storage means, is displayed on the time display means.

Additionally, the operation mode switching means switches the operation mode from the standard mode to the power saving mode (in which the time display means remains in the suspended state) in response the power detecting means detecting that the power generating means is not in the power generating state (i.e. is not generating power), or detecting that the magnitude of the voltage stored in the power storage means is less than the predetermined voltage magnitude. During the power saving mode, the current time is not displayed on the time display means. For example, if the time display means is of a hand-on-dial type, then the hands stop moving. Power required to display the current time is thus conserved.

When the power generating means reverts to the power generation state while the time measurement device is in the power saving mode, the device is switched back from the power saving mode to the standard mode in response to the power detection signal output when the power detecting means detects the power generation state or detects that the magnitude of the voltage stored in the power storage means is equal to or greater than the predetermined value magnitude. The current time is then once again displayed on the time display means. If the time display means is of a hand-on-dial type, hands are quickly moved in a forward direction (or in a reverse direction) to the current time.

The operation mode switching means causes the time display means to display the current time by appropriately using the time information counted by the current time information storage means and the time information received by the receiving means.

The receiving means attempts to receive the radio wave transmitted from the outside and to capture the time information imbedded within the transmitted the radio wave. The receiving means then corrects the current time (i.e. time count value) in the current time information storage means if the time information is successfully received (i.e. captured), and the corrected current time is then displayed on the time display means.

In accordance with the present invention, the current time can be quickly and reliably displayed on the time display means when the device is switched from the power saving mode to the standard mode.

In accord with the present invention, a time measurement device having a power source, a current time information storage means for counting the passage of time, a receiving means for receiving a radio wave bearing time information, and a time display means for displaying the current time, may also include a carried-state detecting means that detects a carried state of the time measurement device (i.e. a state in which the time measuring device is being carried) and that outputs a carried-state detection signal indicative of whether the measuring device is being carried. The measuring device may also include an operation mode switching means that switches, in response to the carried-state detection signal output form the carried-signal detecting means, between the power saving mode (in which the time display means is maintained in a suspended state) and the standard mode (in which the time display means is maintained in an active state). Preferably, the operation mode switching means causes the time display means to display the current time based on the time information counted by the current time information storage means and the time information received by the receiving means in response to the measuring device being switched from the power saving mode to the standard mode.

In the present invention, the power source is not limited to a primary battery or a secondary battery, but may optionally be a generator using a rotating weight or a photovoltaic generator. The secondary battery is charged with generated power or from the outside. The carried-state detecting means may be implemented using, for example, an accelerometer.

When the user uses the time measurement device thus constructed, the carried-state detecting means detects that the time measurement means is being used. When the time measurement device is used, the operation mode switching sets to the standard mode (in which the time display means is in the active state), in response to the carried-state detection signal from the carried-state detecting means. The current time counted by the current time information storage means is therefore displayed on the time display means.

When the user is not using the time measurement device, the operation mode switching means switches the operation mode of the measuring device to the power saving mode (in which the time display means is in the suspended state), in response to the carried-state detection signal from the carried-state detecting means. Accordingly, the current time is not displayed on the time display means. The power that would otherwise be required to display the time can be thus conserved.

When the user again begins using the time measurement device while the device was in the power saving mode, the carried-state detecting means detects that the time measurement device is being used. Then, the operation mode switching means switches the device from the power saving mode to the standard mode in response to the carried-state detection signal from the carried-state detecting means, and the current time is once again displayed on the time display.

The operation mode switching means causes the time display means to display the current time by appropriately using the time information counted by the current time information storage means and the time information received by the receiving means.

The receiving means receives the radio wave bearing the time information transmitted from the outside, and corrects the current time in the current time information storage means in response to successively receiving time information, and the corrected current time is then displayed on the time display means.

In accordance with the present invention, the current time can be quickly and reliably displayed on the time display means when the device is switched from the power saving mode to the standard mode.

In a further aspect of the present invention, when the device is switched from the power saving mode to the standard mode, the operation mode switching means causes first the receiving means to receive the time information, causes the time display means to display the current time in the current time information storage means corrected based on the time information if the receiving means has successfully received the time information, and causes the time display means to display the current time counted by the current time information storage means if the receiving means has failed to receive the time information.

In this arrangement, the operation mode switching means causes the receiving means to receive the time information when the device is switched from the power saving mode to the standard mode. If the receiving means has successfully received the time information, the current time in the current time information storage means is corrected in accordance with the time information. The corrected current time in the current time information storage means is displayed on the time display means. Precise current time based on the received time information can be thus presented.

If the receiving means has failed to receive the time information, the reception attempt to receive the time information is stopped. In succession, the current time (time information) counted by the current time information storage means is displayed on the time display means. This arrangement makes it unnecessary for the user to wait until the reception of the time information is successful, and the display of the current time quickly resumes.

The phrase "based on" of the preceding sentence reading "the operation mode switching means causes the time display means to display the current time based on the time information counted by the current time information storage means and the time information received by the receiving means" is intended to include the case that the operation mode switching means causes the time display means to display the time information in the current time information storage means if the receiving means fails to receive the time information.

Specifically, the phrase "based on" is intended to include the case that the operation mode switching means causes the time display means to display one of the received time information or the time information in the current time information storage means depending on the determination concerning which of the time information, the received time information or the time information of the current time storage means, is appropriate for use when the reception of the radio wave bearing the time information is attempted.

Even when the receiving means fails to receive the time information due to surrounding radio wave conditions, the reception attempts are not repeated in vain, and the current time is quickly displayed in accordance with the current time of the current time information storage means. Specifically, when the device is switched from the power saving mode to the standard mode, the user can quickly learn the current time without being forced to wait on standby for a long extra time.

In case of, for example, a quartz watch, the current time of the current time information storage means has still a time precision as high as a few tens of seconds a month. Therefore, this current time gives rise to no substantial difficulties for use as the time information. The reception attempt to receive the time information may be made subsequent to the displaying of the current time in the current time information storage means. When the receiving means successfully receives the time information, time correction is performed based on the received time information, and the device may exhibit the precision performance thereof as a radio wave corrected watch.

In another aspect of the present invention, when the device is switched from the power saving mode to the standard mode, the operation mode switching means causes first the time display means to display the current time counted by the current time information storage means, and then, corrects the current time, displayed by the time display means, in accordance with the time information received by the receiving means.

In this arrangement, the operation mode switching means causes first the time display means to display the current time (the time information) counted by the current time information storage means when the device is switched from the power saving mode to the standard mode. In succession, the operation mode switching means causes the receiving means to receive the time information. If the receiving means successfully receives the time information, the current time in the current time information storage means is corrected in accordance with this time information. The corrected current time in the current time information storage means is then displayed on the time display means.

In accordance with the present invention, the current time can be quickly displayed on the time display means when the device is switched from the power saving mode to the standard mode, because the current time counted by the current time information storage means is displayed first. Specifically, when the device is switched from the power saving mode to the standard mode, the user can quickly learn the current time without being forced to wait on standby for a long extra time as long as several minutes. The current time counted by the current time information storage means has still a time precision as high as a few tens of seconds a month, and gives rise to no substantial difficulties for use as the time information.

The reception attempt to receive the time information is made subsequent to the displaying of the current time of the current time information storage means. If the receiving means successfully receives the time information, time correction is performed based on the received time information. Therefore, the device may exhibit the precision performance thereof as a radio wave corrected watch.

Further in the present invention, the current time information storage means may include a second-of-time counter for counting the second of the current time and an hour-and-minute-of-time counter for counting the hour and minute of the current time, and when the device is switched from the power saving mode to the standard mode, the operation mode switching means causes the time display means to display the hour and minute counted by the hour-and-minute-of-time counter, while correcting the second of the second-of-time counter in accordance with the time information received by the receiving means to cause the time display means to display the corrected second of the time.

When the device is switched from the power saving mode to the standard mode in the above arrangement, the hour and minute of the time counted by the hour-and-minute-of-time counter are displayed on the time display means first. At the same time, the receiving means receives the time information and the second of the time counted by the second-of-time counter is corrected. The corrected second of the time is then displayed on the time display means.

In accordance with the present invention, the hour and minute time information, which is important as the time information, can be quickly displayed on the time display means when the device is switched from the power saving mode to the standard mode. Therefore, the user can quickly learn the hour and minute information without being forced to wait on standby for an extra time. The current time counted by the hour-and-minute-of-time counter in a quartz watch has still a time precision as high as a few tens of seconds a month, and is sufficient precise for the hour and minute of the time.

Since the second of the time is corrected in accordance with the time information received by the receiving means, the device can exhibit the precision performance thereof as a radio wave corrected watch.

A control method of the present invention for controlling a time measurement device, includes a power generating step of generating power in response to energy coming in from the outside, a power storage step of storing the power generated in the power generating step, a current time information storage step of counting current time, a receiving step of receiving a radio wave bearing time information, and a time display step of displaying the current time, and further includes a power detecting step of outputting a power detection signal when a power generating state in the power generating step or a state that a magnitude of the voltage stored in the power storage step is equal to or greater than a predetermined voltage is detected, an operation mode switching step of switching, in response to the power detection signal detected in the power detecting step, between a power saving mode in which the time display step is maintained in a suspended state and a standard mode in which the time display step is maintained in an active state, wherein the operation mode switching step causes the current time to be displayed in the time display step, based on the time information counted in the current time information storage step and the time information received in the receiving step when the device is switched from the power saving mode to the standard mode.

The above-referenced arrangement provides similar advantages and operation as the embodiments previously described. The current time can be quickly and reliably displayed on the time display means when the device is switched from the power saving mode to the standard mode.

A control method in accord with another aspect of the present invention for controlling a time measurement device having a power source, includes a current time information storage step of counting current time, a receiving step of receiving a radio wave bearing time information, and a time display step of displaying the current time, and further includes a carried-state detecting step of detecting a carried state of the time measurement device and outputting a carried-state detection signal, and an operation mode switching step of switching the device, in response to the carried-state detection signal detected in the carried-state detecting step, between a power saving mode in which the time display step is maintained in a suspended state and a standard mode in which the time display step is maintained in an active state, wherein the operation mode switching step causes the current time to be displayed in the time display step, based on the time information counted in the current time information storage step and the time information received in the receiving step when the device is switched from the power saving mode to the standard mode.

The above-referenced arrangement provides similar advantages and operation as a previously described embodiment. The current time can be quickly and reliably displayed on the time display means when the device is switched from the power saving mode to the standard mode.

In a control method of the present invention, when the device is switched from the power saving mode to the standard mode, the operation mode switching step causes first the receiving step to be performed, causes the current time in the current time information storage step corrected based on the time information to be displayed in the time display step if the reception of the time information has been successful in the receiving step, and causes the current time counted by the current time information storage to be displayed in the time display step if the reception of the time information has failed in the receiving step.

Even when the receiving means fails to receive the time information in the receiving step due to surrounding radio wave conditions, the reception attempts are not repeated in vain, and the current time can be quickly displayed in accordance with the current time in the current time information storage step. Specifically, when the device is switched from the power saving mode to the standard mode, the user can quickly learn the current time without being forced to wait on standby for a long extra time.

Further in the present invention, when the device is switched from the power saving mode to the standard mode, the operation mode switching step causes the current time counted in the current time information storage step to be displayed in the time display step, and then, corrects the current time displayed in the time display step in accordance with the time information received in the receiving step.

When the device is switched from the power saving mode to the standard mode, the current time can be quickly displayed on the time display means because the current time counted in the current time information storage step is displayed first. Specifically, when the device is switched from the power saving mode to the standard mode, the user can quickly learn the current time without being forced to wait on standby for a long extra time.

In a further aspect of the present invention, the current time information storage step includes a second-of-time counting sub-step of counting the second of the current time and an hour-and-minute-of-time counting sub-step of counting the hour and minute of the current time, wherein when the device is switched from the power saving mode to the standard mode, the operation mode switching step causes the hour and minute counted in the hour-and-minute-of-time counting sub-step to be displayed in the time display step, while correcting the second in the second-of-time counting sub-step in accordance with the time information received by in the receiving step to cause the corrected second of the time to be displayed in the time display step.

The hour and minute time information, which is important as the time information, is quickly displayed on the time display step when the device is switched from the power saving mode to the standard mode. Since the second of the time is corrected in accordance with the time information received by the receiving means, the device can exhibit the precision performance thereof as radio wave corrected watch.

Other objects and attainments together with a fuller understanding of the invention will become apparent and appreciated by referring to the following description and claims taken in conjunction with the accompanying drawings.

BRIEF DESCRIPTION OF THE DRAWINGS

In the drawings wherein like reference symbols refer to like parts.

DESCRIPTION OF THE PREFERRED EMBODIMENTS

The embodiments of the present invention will now be discussed with reference to the drawings.

First Embodiment

Figure 1:
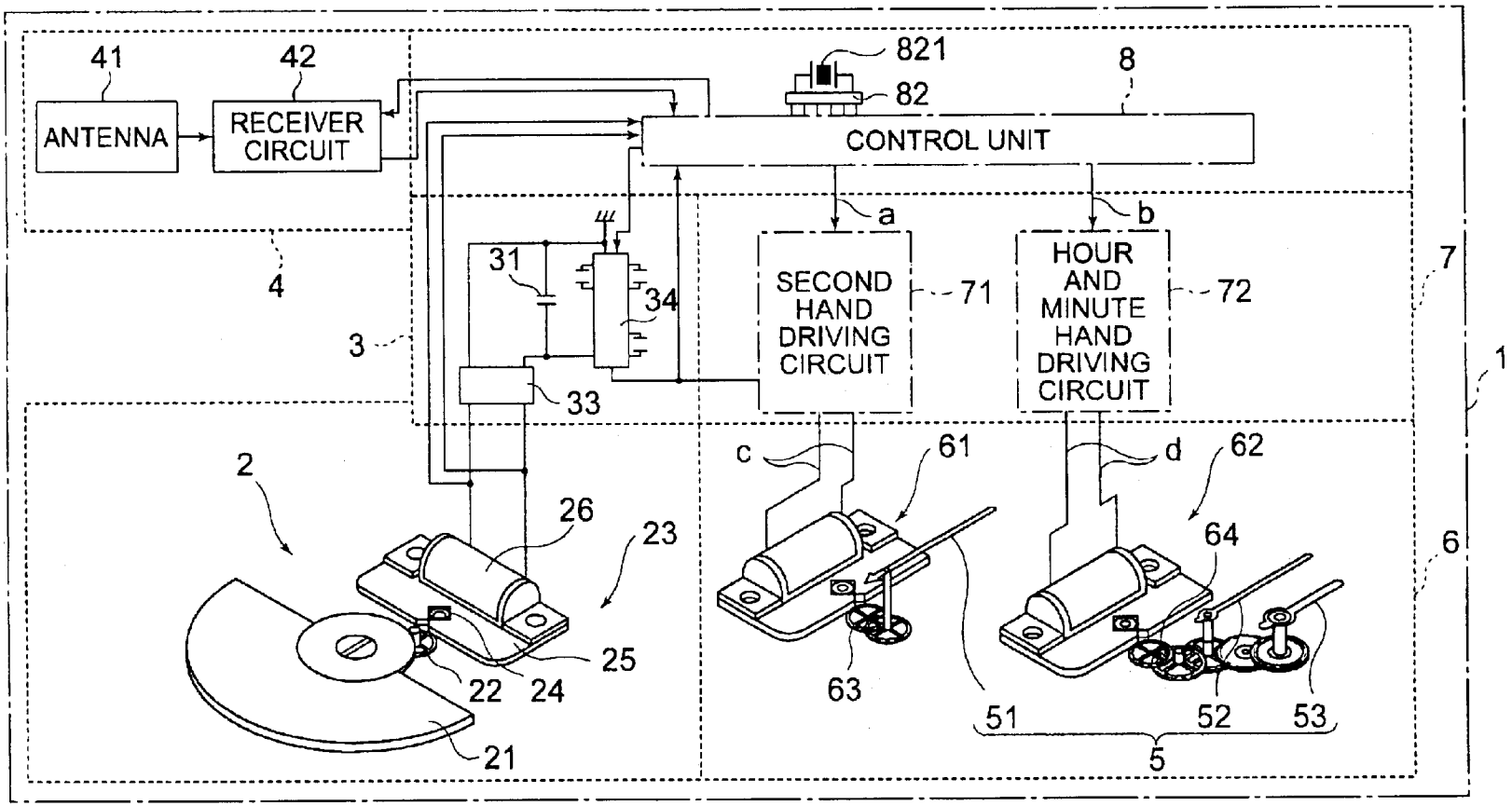
FIG. 1 shows the construction of the radio wave corrected watch as a first embodiment of the time measurement device of the present invention.

FIG. 1 shows a radio wave corrected wrist watch of as a first embodiment of a time measurement device of the present invention.

A radio wave corrected watch 1 includes a power generator 2 as power generating means, a power storage unit 3 for storing power generated by the power generator 2, a receiver 4 for receiving a radio wave bearing time information, a control unit 8 for controlling the driving of the entire device, a hand advancing unit 6 for advancing time-indicating hands as a time display means for indicating the time, and a driving circuit section 7 for driving the hand advancing unit 6 in response to a drive control signal from the control unit 8. These components are housed in a device case (not shown). Belts (not shown) are connected to the device case to allow a user to wear the radio wave corrected watch 1 on the user's wrist.

The power generator 2 includes a semi-circular disk-like rotating weight 21 rotatably supported at the center thereof, a transfer gear 22 for transferring mechanical energy from the rotation of the rotating weight 21, and a power generator 23, which generates power in response to the mechanical energy transferred by the transfer gear 22.

The power generator 2 is a typical one, which includes a generating rotor 24 which is rotated by the mechanical energy transferred by the transfer gear, a generating stator 25, and a generating coil 26.

The power storage unit 3 includes a high-capacity secondary power source 31 working as power storage means, a limiter 32 (see FIG. 3) for preventing the secondary power source 31 from being overcharged, rectifier 33 for rectifying a current from the power generator 2, and voltage step-up circuit 34 for stepping up an output voltage from the secondary power source 31.

The receiver 4 includes an antenna 41 for receiving a radio wave bearing time information transmitted from the outside, and the receiver circuit 42 for processing a signal of the radio wave received by the antenna 41.

The radio wave bearing time information may be the "long-wave time standard radio wave" (JJY). Included as data items in a time code format of the long-wave time standard radio wave are the hour and minute of the current time, total number of days from January first of the current year, current year (typically the lower two digits), the day of the week, and leap second. Time information at the zeroth second of each minute is transmitted at one-minute intervals. The values of the each item are formed of a combination of values assigned to each second. For example, since the long-wave time standard radio wave is based on a cesium atomic clock, the radio wave corrected watch, which corrects time by receiving the long-wave time standard radio wave, can provide an extremely high accuracy, that is, an error of one second every 100 thousand years.

Figure 2:
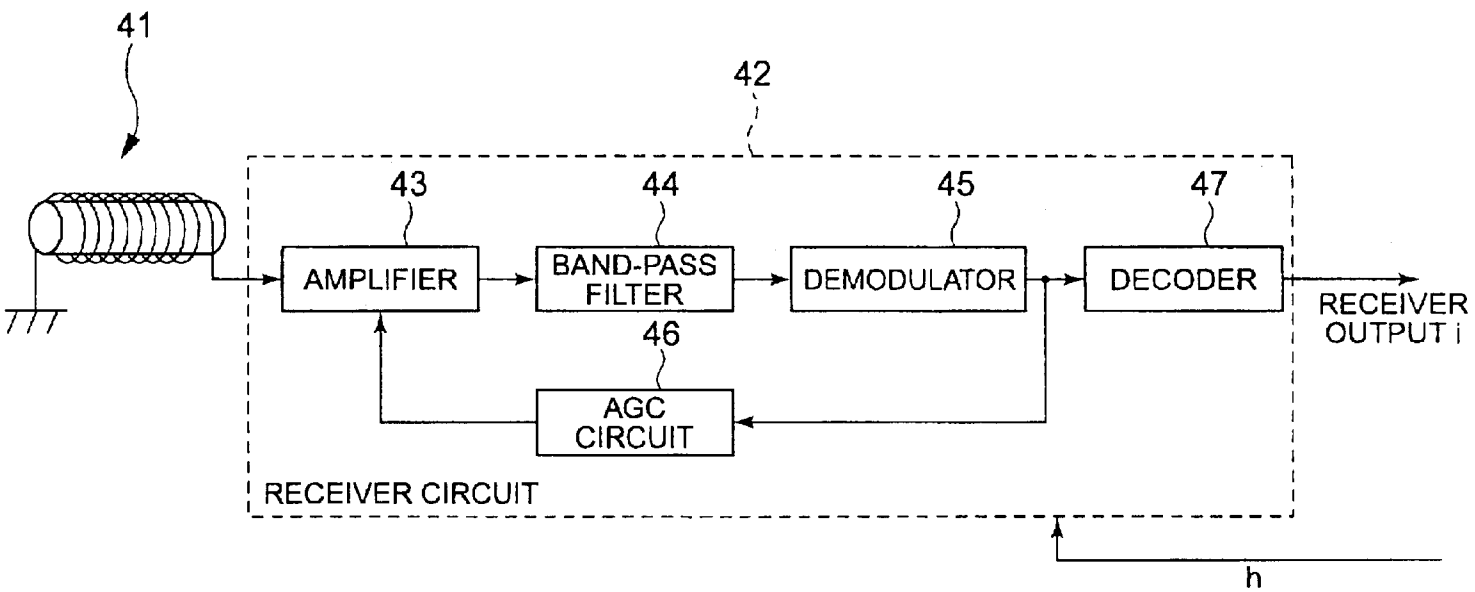
FIG. 2 is a block diagram showing the construction of a receiver circuit in accordance with the first embodiment.

Referring to FIG. 2, the receiver circuit 42 includes an amplifier 43 for amplifying the long-wave time standard radio wave signal received by the antenna 41, a band-pass filter 44 for extracting a desired frequency component from the amplified long-wave time standard signal, a demodulator 45 for smoothing and demodulating the long-wave time standard signal, and an AGC (Automatic Gain Control) circuit 46 for controlling the gain of amplifier 43 so that the received signal level of the long-wave time standard signal remains within a predefined range, and a decoder 47 for decoding the demodulated long-wave standard radio wave and outputting it.

The receiver circuit 42 starts the reception of the time information according to a predetermined schedule or by the transition from the power saving mode to the standard mode. Additional description about this feature is provided later.

Returning to FIG. 1, the time display means 5 includes a second hand 51 indicating the second of the current time, a minute hand 52 indicating the minute of the current time, and an hour hand 53 indicating the hour of the current time. The second hand, minute hand, and hour hand indicates the current time by pointing to a scale on a dial, not shown.

The hand advancing unit 6 includes a second motor 61 for driving the second hand 51, and an hour and minute motor 62 for driving the hour hand 53 and minute hand 52.

The second motor 61 and hour and minute motor 62 are stepping motors, and are respectively driven by pulse signals c and d output from the driving circuit section 7, which receives driving control signals a and b from the control unit 8.

The driving power of the second motor 61 is transferred to the second hand 51 through a train of gears 63. The driving power of the hour and minute motor 62 is transferred to the minute hand 52 and hour hand 53 through a train of gears 64.

The driving circuit section 7 includes a second hand driving circuit 71 for driving the second motor 61 and an hour and minute hand driving circuit 72 for driving the hour and minute motor 62. In response to the driving control signals a and b from the control unit 8, the second hand driving circuit 71 and hour and minute hand driving circuit 72 respectively output second driving pulse signal c for driving the second motor 61 and hour and minute driving pulse d for driving the hour and minute motor 62.

Figure 3:
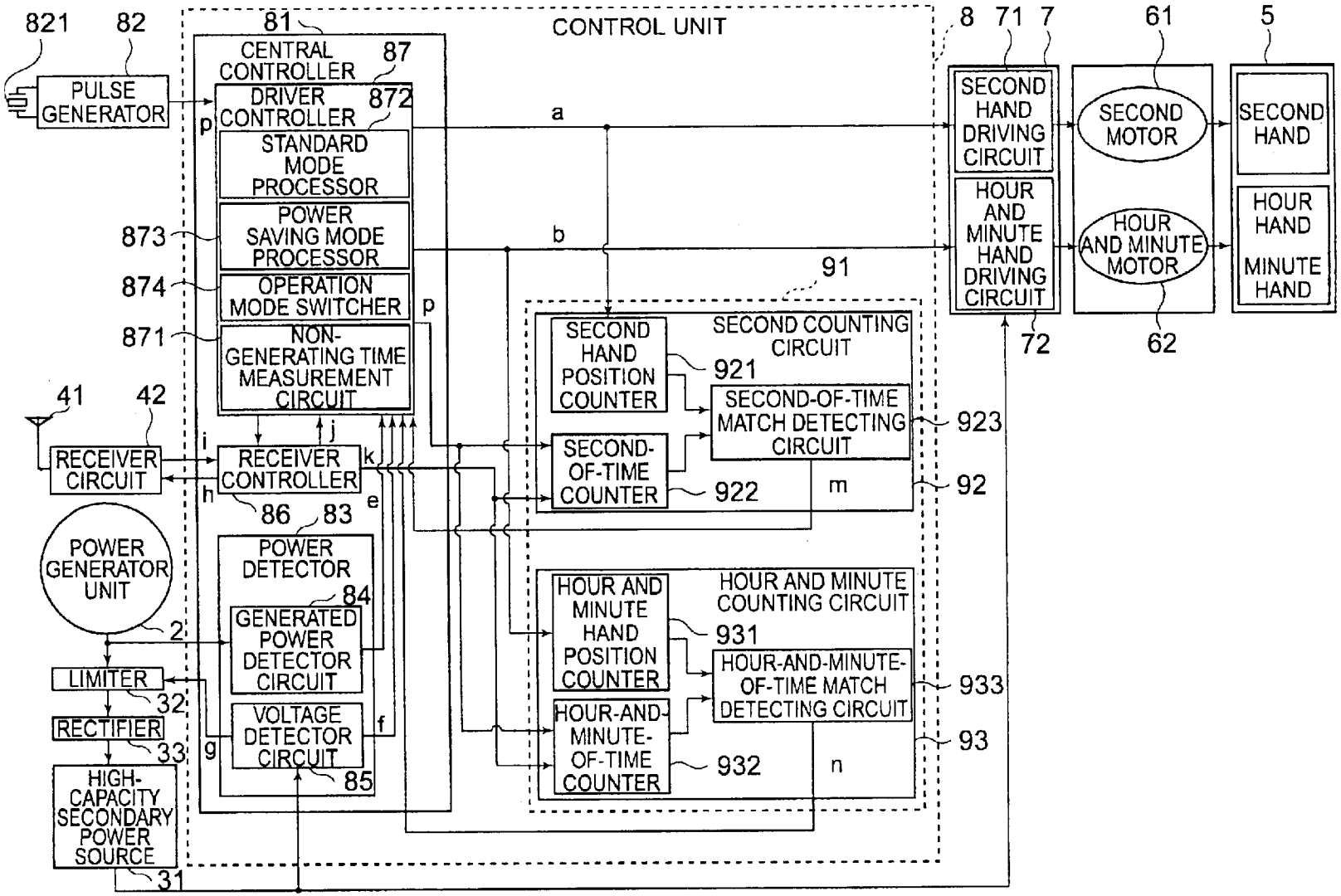
FIG. 3 is a block diagram showing the construction of a control unit in accordance with the first embodiment.

As shown in FIG. 3, the control unit 8 includes a central controller 81 and counter section 91.

The central controller 81 includes a power detector 83 for detecting a generation state of the power generator 2 or a storage voltage at the secondary power source 31, receiver controller 86 for controlling a receiving operation of the receiver circuit 42, and driver controller 87 for controlling the driving operation of the entire device by setting an operation mode. The central controller 81 receives a pulse signal from a pulse generator 82, which generates a clock pulse.

The pulse generator 82 includes an oscillator circuit having a reference oscillation source formed of a crystal resonator 821, and frequency-divides a reference pulse output from the oscillator circuit, thereby generating a variety of pulses including the clock pulse.

The power detector 83 includes a generated power detector circuit 84 for detecting whether or not the power generator 2 is in a power generating state, and voltage detector circuit 85 for detecting a voltage of the secondary power source 31.

Figure 4:
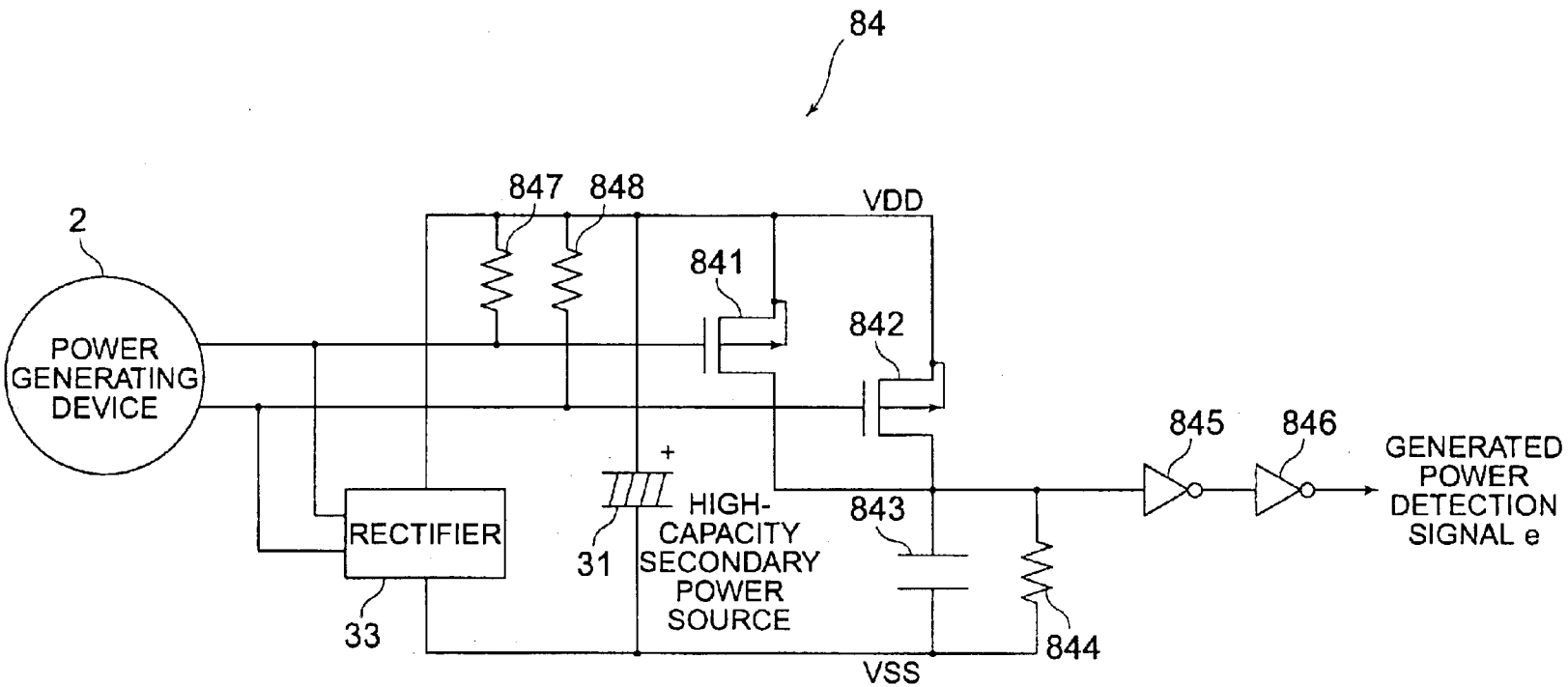
FIG. 4 shows the construction of a generated power detector circuit in accordance with the first embodiment.

FIG. 4 shows the generated power detector circuit 84. The generated power detector circuit 84 includes P-channel transistors 841 and 842, capacitor 843, resistor 844, inverters 845 and 846, and pull-up resistors 847 and 848.

Terminal voltages at both terminals of the power generator 2 are fed to the gates of the P-channel transistors 841 and 842, and a high voltage Vdd is fed to the sources of the P-channel transistors 841 and 842. Drains of the P-channel transistors 841 and 842 are connected to a current drawing terminal of the capacitor 843. A low voltage VSS is connected to the other terminal of the capacitor 843.

The resistor 844 has a high resistance ranging from several tens of Mega ohms to several giga-ohms. The resistor 844 is connected in parallel with the capacitor 843 to discharge the charge in the capacitor 843. The inverter 845 has its input connected to the drains of the P-channel transistors 841 and 842. The inverter 846, connected in series with the inverter 845, provides an output signal serving as a generation detection signal. The low voltage VSS is negative with respect to the high voltage Vdd (=GND), and indicates a voltage difference from the high voltage Vdd. When the power generator 2 generates an electromotive force in the above arrangement, the P-channel transistors 841 and 842 are alternately turned "ON", thereby generating a voltage across the terminals of the capacitor 843. The input to the inverter 845 is driven to an "H" level. In response, the inverter 846 outputs a generation detection voltage signal e to the driver controller 87.

When no electromotive force is generated in the power generator 2 (i.e. power generator 2 is not in the power generating state), the P-channel transistors 841 and 842 remains in an "OFF" state. Since the charge in the capacitor 843 is discharged through the resistor 844, the voltage across the terminals of the capacitor 843 is reduced, and the input to the inverter 845 is transitioned to an "L" level. Therefore, no generation detection signal is output from the inverter 846. Since the generated power detector circuit 84 includes the pull-up resistors 847 and 848, the P-channel transistors 841 and 842 can be reliably set to an "OFF" state without being affected by a residual magnetic field, etc., when no electromotive force is generated in the power generator 2. The generated power detector circuit 84 can control current consumption to zero, thereby decreasing consumed energy from the secondary power source 31.

Returning to FIG. 3, voltage detector circuit 85 detects a voltage supplied from the secondary power source 31. The voltage detector circuit 85 works on two thresholds. A first threshold is a value (a standard voltage value) used to detect a predetermined voltage sufficient to shift to the standard mode from the power saving mode. When a voltage magnitude equal to or greater than the magnitude of the standard voltage value is detected by the voltage detector circuit 85, the voltage detector circuit 85 outputs a voltage detection signal f to the driver controller 87.

A second threshold is a value (a limit voltage value) is used to detect an overcharge condition in the secondary power source 31. When a voltage magnitude equal to or greater than the magnitude of the limit voltage value is detected by the voltage detector circuit 85, the voltage detector circuit 85 outputs a limit voltage signal g to the limiter 32, thereby blocking the charging of the secondary power source 31 from the power generator 2.

The generation detection voltage signal e from the generated power detector circuit 84 and the voltage detection signal f from the voltage detector circuit 85 are collectively referred to as a power detection signal.

The receiver controller 86 controls a receiving operation of the receiver circuit 42. The receiver controller 86 typically outputs a reception start signal h to the receiver circuit 42 at, for example, 10 a.m. and 10 p.m. everyday. Upon receiving the reception start signal h, the receiver circuit 42 starts receiving the long-wave time standard radio wave. The receiver circuit 42 receives several consecutive frames (e.g., five frames) of the long-wave time standard radio wave in a single receiving operation, and compares each consecutive frame to the previous frame for accuracy. The consecutively received time information is temporarily stored in the receiver controller 86. The receiver controller 86 compares the temporarily stored time information with newly the received time information to determine whether or not the reception of the time information is successful. Specifically, the receiver controller 86 determines whether the consecutively received time information accurately shows repeated frame receptions at one minute intervals. If the receiver controller 86 determines that the reception of the time information is successful, the receiver controller 86 outputs a reception success signal j to the driver controller 87, while outputting the received time information k to the counter section 91 at the same time.

The driver controller 87 includes a non-generating time measurement circuit 871, standard mode processor 872, power saving mode processor 873, and operation mode switcher 874.

The non-generating time measurement circuit 871 measures the time lapse during which the power generator 2 generates no power. The non-generating time measurement circuit 871 starts time measurement at the moment the generation detection voltage e from the generated power detector circuit 84 is transitioned to an L level. When a non-generating time lapse reaches a predetermined time period, the device is switched from the standard mode to the power saving mode, and this operation will be detailed later.

The standard mode processor 872 becomes operative when the power generator 2 generates power and when the magnitude of the storage voltage of the secondary power source 31 is equal to or greater than the magnitude of the standard voltage value. While the standard mode processor 872 is operative, the device works in the standard mode for displaying the current time on the time display means 5. The operation of the standard mode will be described later.

While the power saving mode processor 873 is operative, the radio wave corrected watch 1 operates in the power saving mode. Specifically, the driver controller 87 suspends the supply of the driving control signals a and b to the driving circuit 7, thereby stopping the displaying of the time on the time display means 5.

The operation mode switcher 874 constitutes operation mode switching means, and switches the mode between the power saving mode and the standard mode in response to the generation detection signals e and f from the power detector 83.

That is to say, the operation mode switcher 874 controls the transition from the standard mode to the power saving mode and the transition from the power saving mode to the standard mode (operation mode switching step), and will be discussed in detail later.

The counter section 91 includes a seconds counting circuit 92 for counting the passage of seconds in time, and an hour and minute counting circuit 93 for counting the passage of hours and minutes in time.

The seconds counting circuit 92 includes a second hand position counter 921, a second-of-time counter 922, and a second-of-time match detecting circuit 923.

The second hand position counter 921 and second-of-time counter 922 loops to zero every 60 seconds. The second hand position counter 921 counts a driving control signal (second driving control signal a) supplied to the second hand driving circuit 71 from the driver controller 87. Specifically, the second hand position counter 921 counts the seconds in time indicated by the second hand 51, by counting the driving control signal driving the second hand 51.

The second-of-time counter 922 counts a 1 Hz pulse (a clock pulse), which has been frequency-divided by the pulse generator 82 and output through the driver controller 87. Specifically, the second-of-time counter 922 counts the seconds in the current time. Furthermore, the second-of-time counter 922 corrects the count of the seconds in accordance with received time information when the receiver circuit 42 receives the time information.

The second-of-time match detecting circuit 923 detects a match when the count of the second hand position counter 921 and the count of the second-of-time counter 922 agree with each other, and outputs a signal m to the driver controller 87 in response to this match detection result.

The hour and minute counter circuit 93 includes an hour and minute hand position counter 931, an hour-and-minute-of-time counter 932, and an hour-and-minute-of-time match detecting circuit 933.

Both the hour and minute hand position counter 931 and hour-and-minutes-of-time-counter 932 loop to zero every 24 hours. The hour and minute hand position counter 931 counts the driving control signal (hour and minute driving control signal b) supplied from the driver controller 87 to the hour and minute hand driving circuit 72. Specifically, the hour and minute hand position counter 931 counts the hour and minute indicated by the hour hand 53 and minute hand 52, respectively, by counting the driving control signal driving the hour hand 53 and minute hand 52.

The hour-and-minute-of-time counter 932 counts a 1 Hz pulse (a clock pulse), which has been frequency-divided by the pulse generator 82 and output through the driver controller 87 (more precisely, the hour-and-minute-of-time counter 932 outputs one count when 60 pulses of 1 Hz are counted). Specifically, the hour-and-minute-of-time counter 932 counts the hour and minute of time of the current time. Furthermore, the hour-and-minute-of-time counter 932 corrects the count of the hours and minutes in time in accordance with the received time information when the receiver circuit 42 receives the time information.

The hour-and-minute-of-time match detecting circuit 933 detects a match when the count of the hour and minute hand position counter 931 and the count of the hour-and-minute-of-time counter 932 agree with each other, and outputs a signal n to the driver controller 87 in response to the match detection result.

The second-of-time counter 922 and hour-and-minute-of-time counter 932 constitute a time counter functioning as a current time information storage means, and perform a current time information storage step.

The second hand position counter 921 and hour and minute hand position counter 931 constitute a hand position counter.

The operation of the first embodiment thus constructed is discussed with reference to FIG. 5 and FIG. 6.

Figure 5:
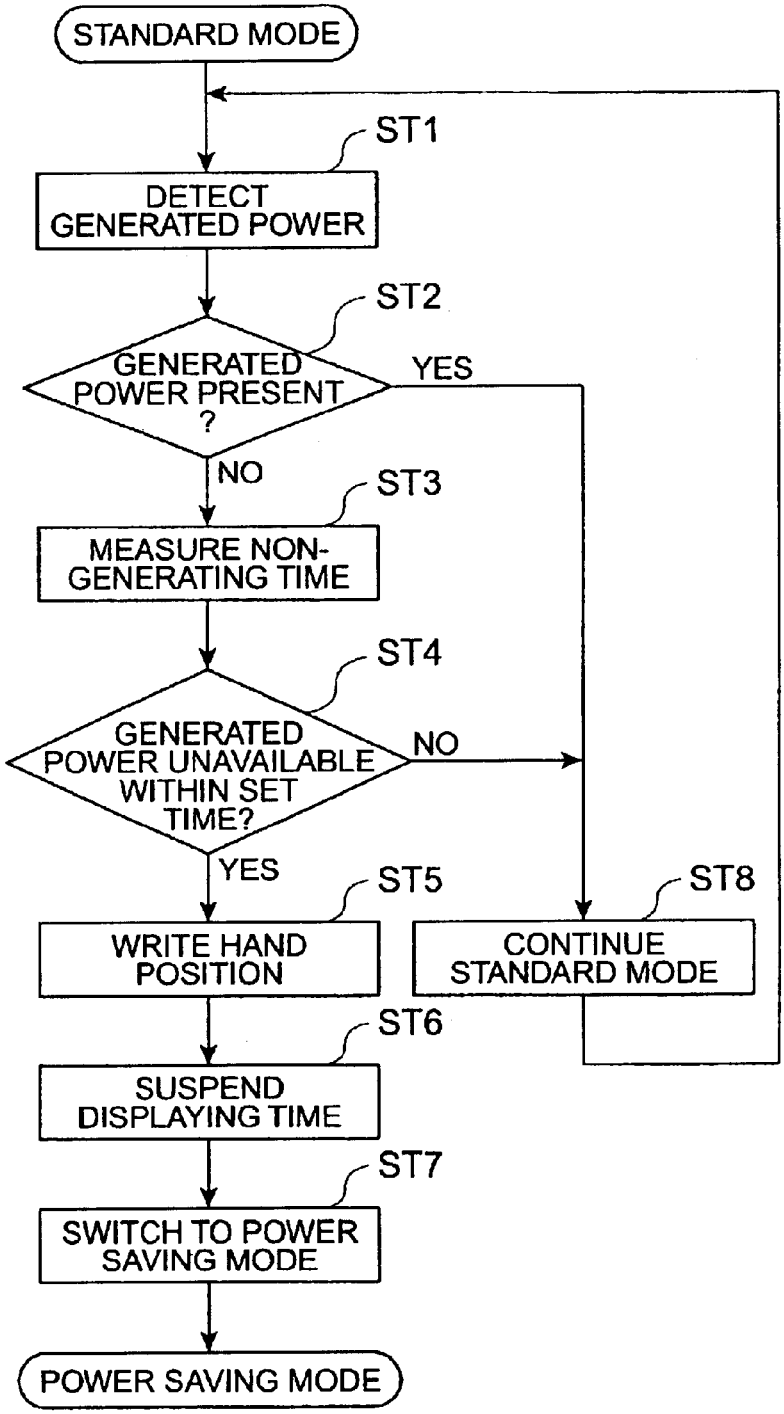
FIG. 5 is a flow diagram showing the operation of transition from a standard mode to a power saving mode in accordance with the first embodiment.

As shown in FIG. 5, when the device operates in the standard mode, the generated power detector circuit 84 detects whether the power generator 2 generates power (ST1). If the generated power detector circuit 84 detects in ST2 that the power generator 2 generates power, the process continues in the standard mode (ST8).

The operation of the standard mode is discussed.

During normal use, the user wears the radio wave corrected watch 1 on an arm, with the wristband of the watch wrapped around the arm's wrist. When the user shakes the arm, the rotating weight 21 rotates. The rotation of the rotating weight 21 rotates the generating rotor 24, and power is generated in the generating coil 26 in response a variation in a magnetic field transferred through the generating stator 25. In other words, the power generator 2 performs a power generating step.

Power generated by the power generator 2 is stored in the secondary power source 31 through the limiter 32 and rectifier 33 (a power storage step). The power generated by the power generator 2 is detected by the generated power detector circuit 84 (a power detecting step), and the generation detection signal e is output by the generated power detector circuit 84 to the driver controller 87. Power stored in the secondary power source 31 drives the entire device while being detected by the voltage detector circuit 85 (the power detecting step). When a voltage magnitude equal to or greater than the magnitude of the standard voltage value is detected by the voltage detector circuit 85, the voltage detection signal f is output to the driver controller 87. When the driver controller 87 receives the generation detection signal e and voltage detection signal f, the standard mode processor 872 remains operative.

When the voltage detector circuit 85 detects a voltage magnitude value equal to or greater than the magnitude of the limit voltage value, the signal g is output from the voltage detector circuit 85 to the limiter 32. The limiter 32 in turn decouples the secondary power source 31 from the power generator 2, thereby preventing the secondary power source 31 from being overcharged.

When the device is set in the standard mode with the standard mode processor 872 activated, the time display means 5 presents the current time (a time display step). Specifically, the driver controller 87 outputs the driving control signals a and b to the driving circuit 7 to display, on the time display means 5 (the second hand 51, minute hand 52, and hour hand 53), the current time counted by the second-of-time counter 922 and hour-and-minute-of-time counter 932 in the counter section 91. Specifically, the driver controller 87 outputs the driving control signal a for driving the second hand driving circuit 71 and the driving control signal b for driving the hour-and-minute-hand driving circuit 72. The second-of-time match detecting circuit 923 detects a match between the second hand position counter 921 and second-of-time counter 922, and the hour-and-minute-of-time match detecting circuit 933 detects a match between the hour and minute hand position counter 931 and hour-and-minute-of-time counter 932.

The receiver controller 86 outputs the signal h for causing the receiver circuit 42 to start receiving the time information when a predetermined reception time is reached. When the receiver circuit 42 has successfully received the time information, the time information k is output to the time counter (including the second-of-time counter 922 and hour-and-minute-of-time counter 932), thereby correcting the current time on the time counter.

The driver controller 87 outputs the driving control signals a and b to display the corrected current time on the time display means 5.

If it is determined in ST2 that no power generation is being performed (GENERATED POWER PRESENT?: NO), the non-generating time measurement circuit 871 measures the time lapse during this non-generating time (ST3). If it is determined in ST4 that the non-generating time has continued for a predetermined "set time" (POWER GENERATION UNAVAILABLE WITHIN SET TIME?: YES), the operation mode switcher 874 switches the operation mode from the standard mode to the power saving mode (an operation mode switching step) according to the result. Specifically, it is determined that the user takes off the radio wave corrected watch 1 from the wrist, and does not use it. The second hand position counter 921 and hour and minute hand position counter 931 store (i.e. write) the current positions of the second hand 51, the hour hand 53, and minute hand 52, respectively (ST5). The supply of the driving control signals a and b from the driver controller 87 is then suspended, and the displaying of the time on the time display means 5 is suspended (ST6). The operation of the standard mode processor 872 stops and the power saving mode processor 873 is then activated. The power saving mode resumes (ST7).

If the non-generating time does not continue for the predetermined "set time" in ST4, it is determined that the radio wave corrected watch 1 is being used, and the standard mode continues (ST8).

The power saving mode will now be discussed.

During the power saving mode, the driving control signals a and b from the driver controller 87 are suspended and no time display is presented on the time display means 5. However, the second-of-time counter 922 and hour-and-minute-of-time counter 932 continue to track the current time by counting the clock pulse p from the pulse generator 82. Although the counts fail to match each other in the second-of-time match detecting circuit 923 and hour-and-minute-of-time match detecting circuit 933, the second-of-time match detecting circuit 923 and hour-and-minute-of-time match detecting circuit 933 accommodate such a mismatch.

While the power saving mode is activated, the receiver circuit 42 stops receiving the time information. Even when the predetermined reception time is reached, the receiver controller 86 issues no reception start command to the receiver circuit 42. Specifically, during the power saving mode, the time information is not received.

Figure 6:
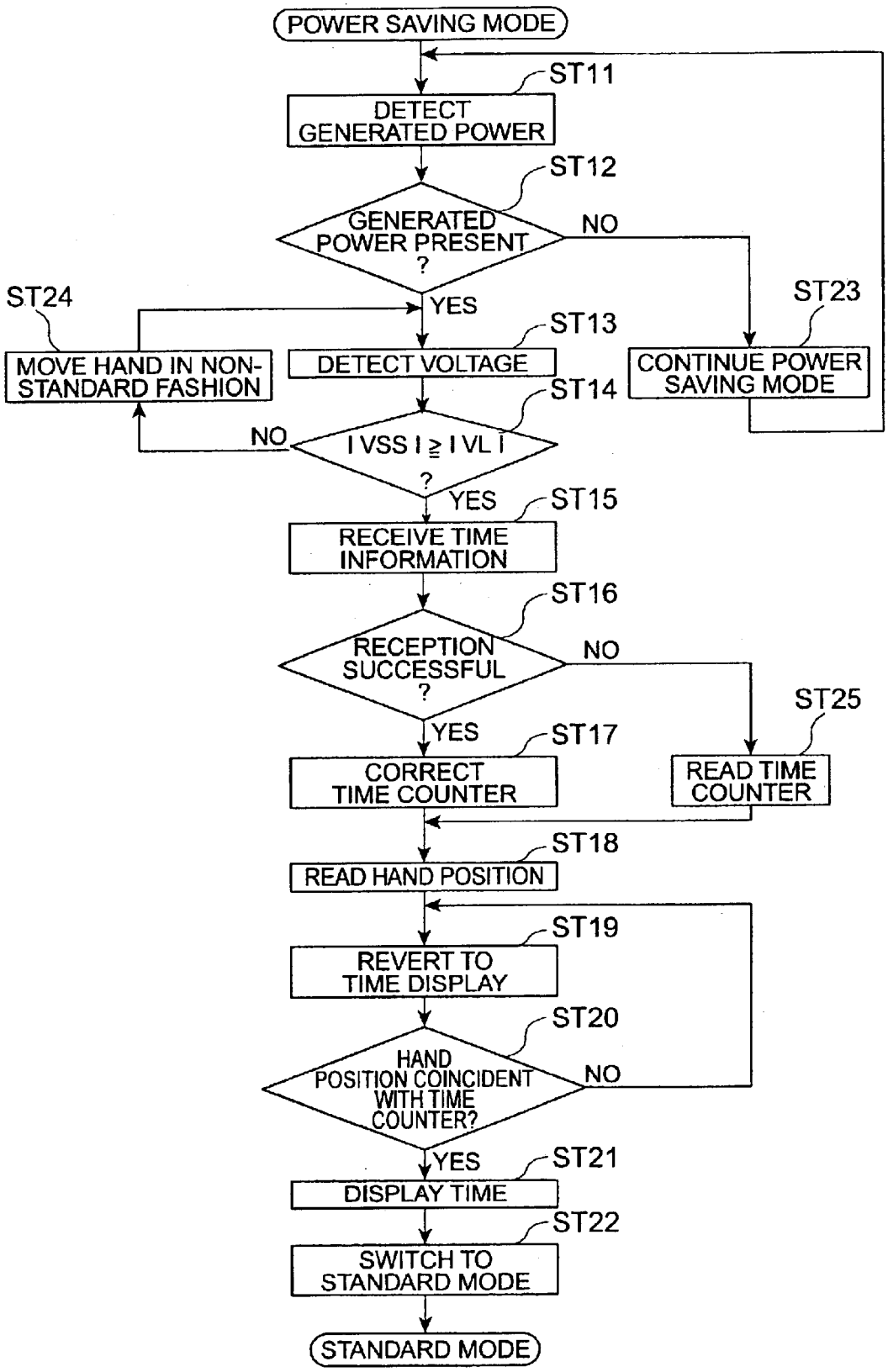
FIG. 6 is a flow diagram showing the operation of transition from the power saving mode to the standard mode in accordance with the first embodiment.

As shown in FIG. 6, during the standard mode, the generated power detector circuit 84 detects whether or not the power generator 2 generates power (ST11). If it is determined in ST12 that power is generated (GENERATED POWER PRESENT?:YES), then the voltage detector circuit 85 observes the storage voltage (ST13). If it is determined in ST14 that the magnitude of the storage voltage VSS is equal to or greater than the magnitude of the standard voltage value VL (YES), the operation mode switcher 874 switches the operation mode from the power saving mode to the standard mode. Specifically, it is determined that the user wears the radio wave corrected watch 1 on the wrist. Then, the receiver circuit 42 first receives the time information (ST15). The time information is received by the receiver circuit 42 and output to the receiver controller 86, which in turn determines whether the reception has been successful (ST16). If the receiver controller 86 determines that the reception has been successful, the receiver controller 86 issues a reception success notification j to the driver controller 87 while correcting the counts at the second-of-time counter 922 and hour-and-minute-of-time counter 932 (ST17). In succession, hand positions stored in the second hand position counter 921 and hour and minute hand position counter 931 are read (ST18). The driver controller 87 outputs the driving control signals a and b in response to the signals from the second-of-time match detecting circuit 923 and hour-and-minute-of-time match detecting circuit 933, thereby causing the hands (the second hand 51, minute hand 52 and hour hand 53) to quickly move in a forward direction (or in a backward direction) to indicate the current time on the time display means 5 (ST19). When the count of the hand position counter and the count of the time counter match each other (ST20), the current time is displayed on the time display means 5 (ST21). The standard mode processor 872 is then operated, resuming the standard mode (ST22).

If it is determined in ST16 that the reception of the time information is not successful, the reception attempt is suspended, and the receiver controller 86 issues a reception failure notification j to the driver controller 87. The time information being counted by the time counter is then read in ST25. To display the current time of the time counter on the time display means 5, the driver controller 87 outputs the driving control signals a and b to quickly move the hands (the second hand 51, minute hand 52, and hour hand 53) in a forward direction (or in a backward direction) until the counts of the hand position counter and time counter match each other. The current time is displayed on the time display means 5 when the counts of the hand position counter and time counter match each other.

When no power generation from the power generator is detected in ST12, the power saving mode continues (ST23).

If the magnitude of the storage voltage VSS in the secondary power source 31 is less than the standard voltage value in ST14, the hands of the time display means 5 are moved in a non-standard fashion (ST24). The non-standard hand movement means that the step of the movement of the second hand 51 is changed to be different from the standard time display, for example.

The first embodiment thus constructed can provide the following advantages.

(1) The receiver circuit 42 first receives the time information when the device is switched from the power saving mode to the standard mode. If the reception is successful, the time display is presented based on the received time information, and precise current time is displayed when the standard mode resumes.

(2) When the device is switched from the power saving mode to the standard mode, the time counted by the time counter is displayed even if the reception of the time information is not successful. Even if the reception of the time information is not successful, the current time can be displayed. This arrangement eliminates the need to repeat the reception until the reception of the time information is successful, and the current time can be quickly displayed. As a result, the ease of use is assured without forcing the user to wait on standby for an extra time.

(3) With a sufficient power saved during the power saving mode, precise time to within a few tens of seconds per month is provided by the time counter. No substantial difficulties are experienced when the time on the time counter is displayed.

(4) When the voltage detector circuit 85 incorporated in the device detects that the magnitude of the storage voltage in the secondary power source 31 is not equal to or greater than the standard voltage value, the device is not switched from the power saving mode to the standard mode. In other words, the receiver circuit 42 does not carry out the reception of the time information if the storage voltage is below the standard voltage value. In this arrangement, the receiver circuit 42 is prevented from erratically receiving the time information due to lack of power during the reception of the time information. As a result, the device enjoys a higher possibility that the time information can be precisely received, and the device can present a precise time display.

(5) When the generated power detector circuit 84 incorporated in the device detects that the power generator 2 generates no power, the device is set to the power saving mode with no time display presented. Power consumption can thus be reduced. Since power consumption is decreased and generated power is efficiently utilized with power saved, the size of the secondary power source 31 can be reduced. A compact design can be thus achieved in the radio wave corrected watch 1, itself.

(6) When the voltage detector circuit 85 incorporated in the device detects that the storage voltage in the secondary power source 31 is below the standard voltage value, the second hand 51 is moved in the non-standard fashion. With the second hand 51 moved in the non-standard fashion, the user can determine that the device starts to shift to the standard mode from the power saving mode regardless of the lack of power. During the use of the radio wave corrected watch 1, the user may worry about the possibility of device failure if no movement is perceived for a period of time needed for the storage voltage to rise. With the non-standard movement of the hands, it can be shown that the standard mode resumes when the storage voltage rises after the waiting time.

Second Embodiment

A second embodiment of the present invention will now be discussed. The basic structure of the second embodiment is the same as that of the first embodiment, and the feature of the second embodiment lies in the operation thereof performed when the power saving mode reverts to the standard mode.

Figure 7:
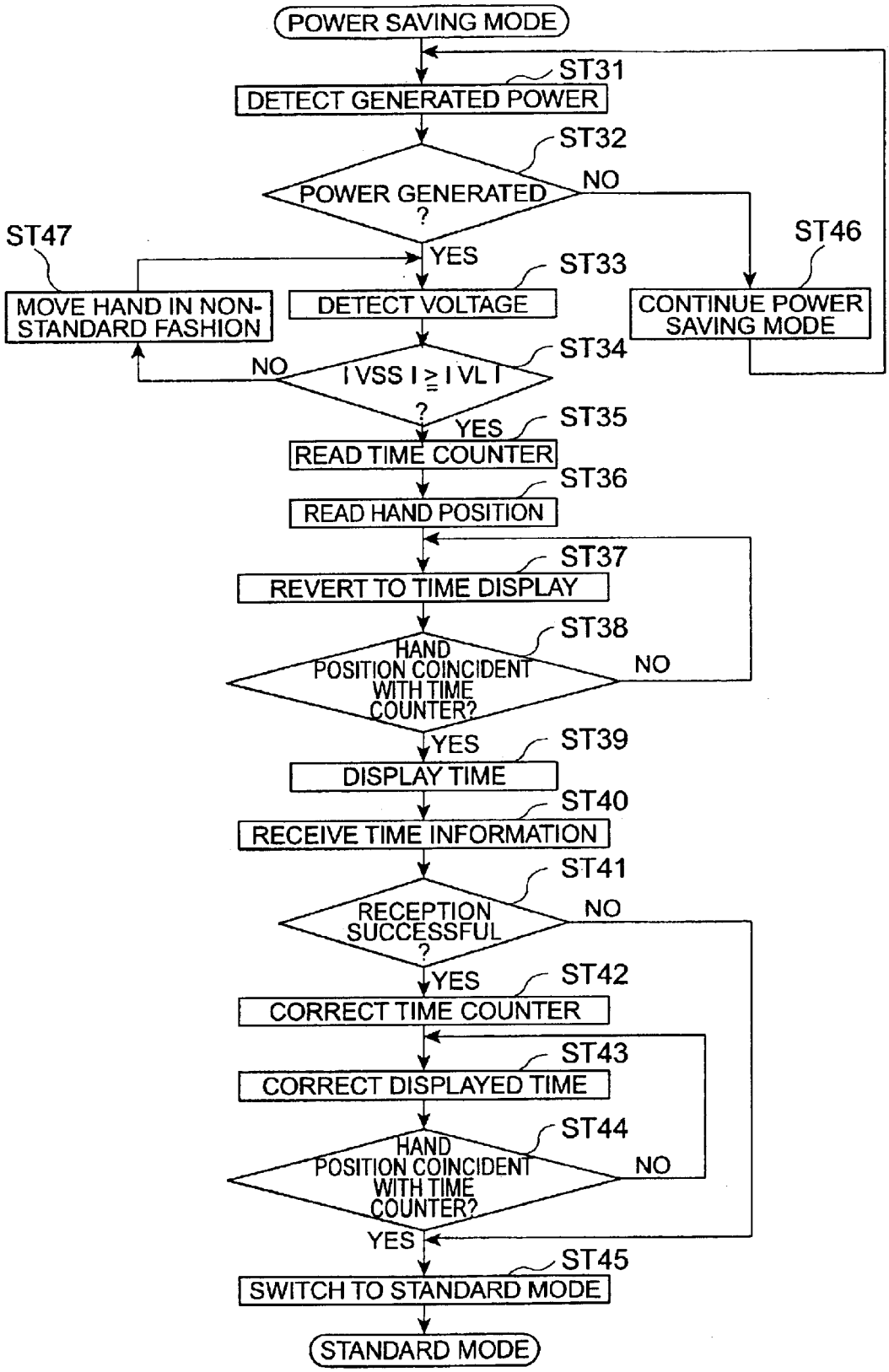
FIG. 7 is a flow diagram showing the operation of transition from the power saving mode to the standard mode in accordance with a second embodiment of the time measurement device of the present invention.

FIG. 7 shows a flow diagram of the second embodiment when the device reverts to the standard mode from the power saving mode.

The second embodiment remains unchanged from the first embodiment in the two steps, in which, when the user wears the radio wave corrected watch 1 on the wrist again for use out of the power saving mode, the generated power detector circuit 84 detects whether the power generator 2 generates power (ST31), and the voltage detector circuit 85 detects whether the magnitude of the storage voltage VSS in the secondary power source 31 is equal to or greater the standard voltage value VL (ST34).

When it is determined that the magnitude of the storage voltage VSS is equal to or greater than the magnitude of the standard voltage value VL (YES), the operation mode switcher 874 switches the device from the power saving mode to the standard mode in ST34.

First, the counts of time counter (the second-of-time counter 922 and hour-and-minute-of-time counter 932) are read (ST35), and the counts of the hand position counter (the second hand position counter 921 and hour and minute hand position counter 931) are read (ST36). In succession, the driver controller 87 outputs the driving control signals a and b so that the count in the time counter and the count in the hand position counter match each other, and thus the hands are quickly moved in a forward direction (or in a backward direction) and the time display resumes (ST37). When the hand position counter and the time counter match in count thereof (ST38), the time display means 5 reverts to displaying the time (ST39).

The receiver circuit 42 receives the time information (ST40). The time information is received by the receiver circuit 42 is then output to the receiver controller 86, which in turn determines whether or not the reception has been successful (ST41). If the receiver controller 86 determines that the reception has been successful, the receiver controller 86 outputs, to the driver controller 87, a reception success notification j that the reception has been successful, while correcting the counts at the second-of-time counter 922 and the hour-and-minute-of-time counter 932 (ST42). In response to the signals m and n respectively output from the second-of-time match detecting circuit 923 and hour-and-minute-of-time match detecting circuit 933, the driver controller 87 outputs the driving control signals a and b, thereby displaying the current time on the time display means 5 (ST43). When the hand position counter and time counter match each other in the counts thereof (S44), the time display on the time display means 5 is corrected, and the device reverts to the standard mode (ST45).

If the time information has not been successfully received in ST41, the device reverts to the standard mode without correcting the time (ST45).

If the power generation condition is not detected in ST32, the power saving mode continues (ST46).

If it is determined in ST34 that the storage voltage VSS is below the standard voltage value VL, the second hand 51 is moved in a non-standard fashion (ST47).

The second embodiment thus constructed provides the following advantages in addition to advantages (3), (4), (5), and (6) of the first embodiment.

(7) When the device is switched from the power saving mode to the standard mode, the current time is displayed on the time display means in accordance with the current time counted by the time counter. Upon being returned to the standard mode from the power saving mode, the time display is quickly presented. As a result, the user is free from waiting time before the reception of the time information, and the user thus enjoys a high degree of convenience because the user can immediately learn the current time when requires.

(8) The receiver circuit 42 receives the time information after the device reverts to the time display upon returning from the power saving mode. If the reception of the time information is successful, the current time is corrected in accordance with the received time information, and the device presents precise time as the radio wave corrected watch.

Third Embodiment

Figure 8:
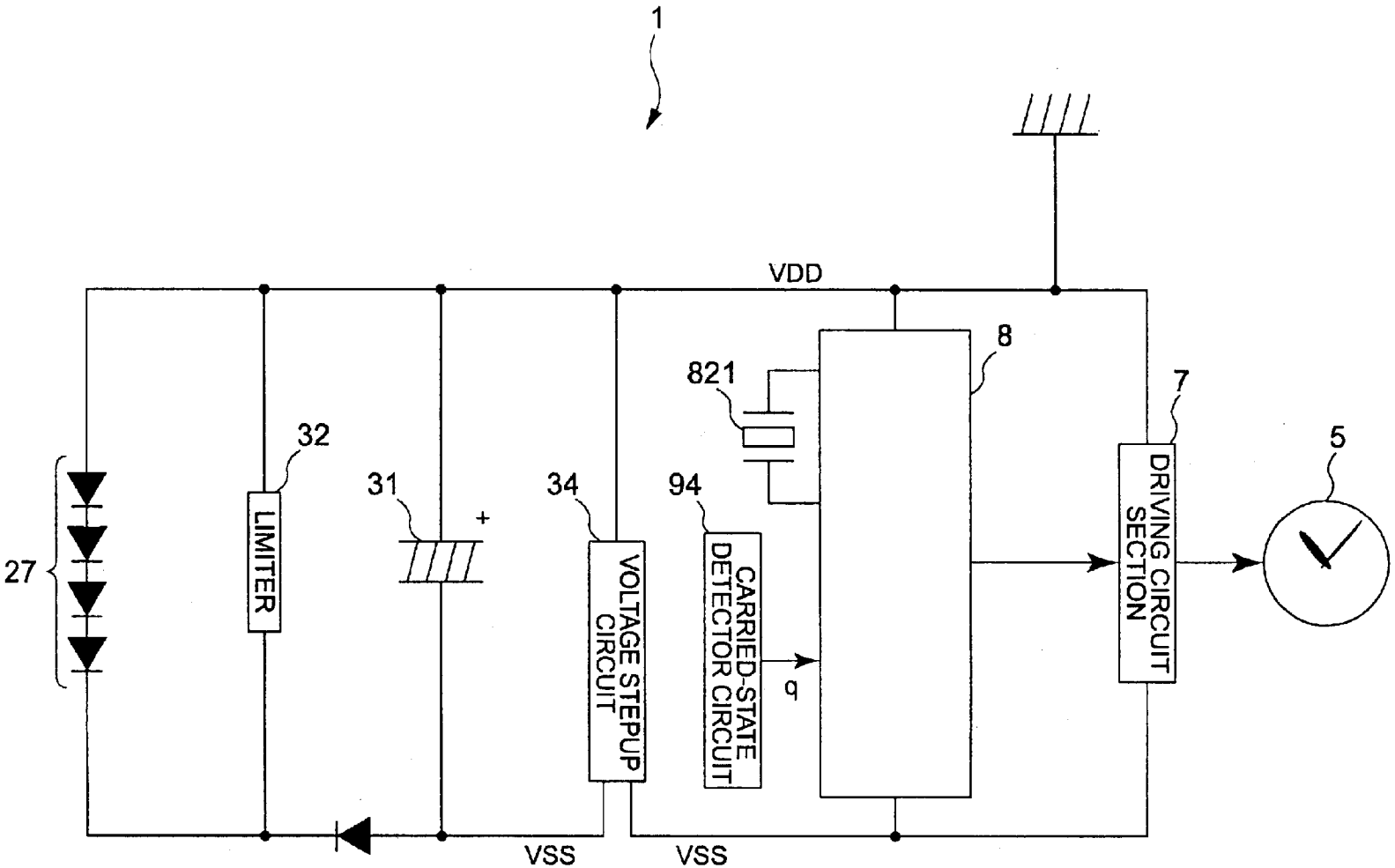
FIG. 8 shows a third embodiment of the time measurement device of the present invention.

FIG. 8 illustrates a third embodiment of the present invention. The third embodiment is basically identical to the first and second embodiments in structure, and the third embodiment has the following features.

The third embodiment has a solar cell 27 as a power source. The third embodiment includes a carried-state detector circuit 94 as carried-state detecting means instead of the generated power detector circuit 84 used in both the first and second embodiments. The carried-state detector circuit 94 may employ an acceleration sensor which detects acceleration taking place when the user wears the radio wave corrected watch 1 on the wrist.

When the user uses the radio wave corrected watch 1 mounted on the wrist, the carried-state detector circuit 94 can detect a motion generated in the radio wave corrected watch 1 (a carried-state detecting step). When a carried-state is detected, the carried-state detector circuit 94 outputs a carried-state detection signal q to the control unit 8, and the radio wave corrected watch 1 operates in the standard mode based on the assumption that the radio wave corrected watch 1 is being carried. If the carried-state detector circuit 94 detects no carried-state signal for a predetermined period of time, the time displaying is suspended on the time display means 5, and the power saving mode resumes on the assumption that the radio wave corrected watch 1 is not being used.

When the user uses the radio wave corrected watch 1 set in the power saving mode and when the carried-state detector circuit 94 detects a carried state, the device is switched from the power saving mode to the standard mode. The transition of the mode from the power saving mode to the standard mode may be performed in the same way as in the first embodiment. Specifically, the receiver circuit 42 attempts to receive the time information, and if the reception is successful, the time displaying is performed based on the time information. If the reception of the time information fails, time displaying is performed based on the time counted by the time counter.

The transition operation from the power saving mode to the standard mode may be performed in the same way as in the second embodiment. Specifically, the time of the time counter is displayed on the time display means 5. Then, the receiver circuit 42 receives the time information, and the time display may be corrected in accordance with this time information.

The third embodiment can provide the following advantages in addition to the advantages (1)–(8) of the first and second embodiments.

(9) Since the carried-state detector circuit 94 is provided, whether or not the radio wave corrected watch 1 is used is determined based on the motion generated in the radio wave corrected watch 1. Specifically, when the radio wave corrected watch 1 is carried by the user, the standard mode is activated. On the other hand, when the radio wave corrected watch 1 is not used by the user, the power saving mode is used.

When the solar cell 27 is used as a power source, the generation state of the solar cell 27 does not necessarily agree with the use state of the radio wave corrected watch 1. For example, the solar cell 27 does not generate power when the solar cell 27 is used under a dark environment. If the power saving mode is activated with the solar cell 27 generating no power, no time display is presented even though the radio wave corrected watch 1 is used. However, if the carried-state detector circuit 94 detects the carried state, the time display is presented under the standard mode when the user uses the radio wave corrected watch 1, whereas no time display is presented with the power saving mode activated when the user does not use the radio wave corrected watch 1. The mode transition operation is more natural to the user.

(Modification 1)

A modification 1 of the first, second and third embodiments may be contemplated as follows. When the device is switched from the power saving mode to the standard mode, as for the hour and minutes of the time, the count at the hour-and-minute-of-time counter 932 may be displayed on the time display means 5 while the receiver circuit 42 may attempt to receive the time information at the same time. If the reception of the time information is successful, the time display means 5 displays the time of the time counter corrected with the received time information. If the reception of the time information fails, the time display means 5 continuously displays the count at the second-of-time counter 922.

When the device is switched from the power saving mode to the standard mode in this arrangement, an important portion of the time information can be quickly presented as for the hour d minutes of the time. This arrangement eliminates the need for the user to wait for the time display to revert back, and provides a high degree of convenience to the user.

If the reception of the time information is successful, time correction may be performed based on the time information, and precise time can be displayed.

Since the time precise counted by the time counter is within tens of seconds a month, the possibility that the count at the hour-and-minute-of-time counter 932 for the hour and minute is precise is high. In other words, even when time correction is performed based on the received time information, it typically suffices to correct the second of the time. As for the hour and minute of the time, the time display of the hour-and-minute-of-time counter 932 can be performed without the need for waiting for the reception of the time information. As for the second, the time information may be received while the time display of the hour and second resumes, and an operation mode transition is thus performed with minimum loss of time.

Time information is transmitted at zero second every minute in the long-wave time standard broadcasting. The time correction of the second can be performed by simply correcting synchronization with a zero second position marker, leading to simplicity.

The time measurement device of the present invention and the control method for controlling the time measurement device are not limited to the above embodiments, and a variety of changes are possible without departing from the scope of the present invention.

Although the driving circuit 7 includes the second hand driving circuit 71 and hour-and-minute-hand driving circuit 72, and the hand advancing unit 6 includes the two motors, i.e., the second motor 61 for driving the second hand 51, and the hour and minute motor 62 for driving the minute hand 52 and hour hand 53, the driving circuit may be a single circuit, and the hand advancing unit may be a single motor. If a single motor is used, the counter section 91 may include a single counting circuit.

Alternatively, a three-motor construction may be used in which the second hand 51, minute hand 52, and hour hand 53 may have respective motors and driving circuits. In such a construction, the hands are independently operated. As a result, when the device reverts to the standard mode from the power saving mode, or when time correction is performed using the time information, there is no need for the minute hand 52 to turn one revolution to move the hour hand 53, and time correction is quickly performed.

The second hand position counter 921 and hour and minute hand position counter 931 count the positions of the hands by counting the driving control signals output from the driver controller 87, and alternatively, hand position detector means for detecting the hands may be arranged and data based on the result of detection may be set in the second hand position counter 921 and hour and minute hand position counter 931.

In the first embodiment, the power generator 2 is not limited to the power generator which generates power by rotating a rotor with a moving weight, and alternatively, the power generator 2 may be a power generator using a piezoelectric element, or a thermal generation device which utilizes a difference in temperature between the body temperature at the time of wearing the watch on the wrist and outside air temperature.

In the second embodiment, the receiver circuit receives the time information after the current time of the time counter is displayed on the time display means when the device is switched from the power saving mode to the standard mode, but alternatively, the receiver circuit may receive the time information in a concurrent operation at the same time as the device reverts to time displaying. The concurrent operations permit a transition operation with accordingly smaller loss of time.

The receiver 4 receives not only the long-wave time standard radio wave but also FM radio wave signal or a GPS (Global Positioning Signal). Depending on the type of radio waves to be received, the antenna 41 should be appropriately changed in construction.

In the preceding embodiments, the time display means is of an analog type with the second hand 51, minute hand 52, and hour hand 53, but a digital display type using an LCD or LED is perfectly acceptable. In the digital display type, the time of the time counter is simply displayed when the device is switched from the power saving mode to the standard mode, and the operation is simple and quick. Unlike the analog display type, the digital display type does not need to quickly move the hands to revert to the time displaying, and permits a quick operation mode transition.

In the above embodiments, the standard mode processor 872, power saving mode processor 873, operation mode switcher 874, and non-generating time measurement circuit 871 in the driver controller 87 and the receiver controller 86 may be formed of a computer including a CPU, ROM/RAM. Control discussed with reference to FIGS. 5, 6, and 7 may be performed by installing a predetermined program in the computer. In this way, set values may be easily modified.

For example, whether to perform the method of the first embodiment or the method of the second embodiment in the operation of switching the mode from the power saving mode to the standard mode may be easily set by modifying the setting in the operation mode switcher 874. It is also easy to set how many times the receiver circuit 42 receives the time information. If the receiver circuit 42 fails to receive the time information in the first embodiment, the reception attempt may be performed once or twice more.

The program of the above computer may be installed through communication means such as the Internet or a storage medium such as CD-ROM and a memory card. Since the antenna 41 is arranged, the program may be supplied wirelessly, and then installed.

In the above embodiments, the second hand position counter 921, second-of-time counter 922, second-of-time match detecting circuit 923, hour and minute hand position counter 931, hour-and-minute-of-time counter 932, and hour-and-minute-of-time match detecting circuit 933 may be formed of a computer containing a CPU and an ROM/RAM, and a predetermined program may be installed into the computer.

In the modification 1, the power source may be a primary battery instead of a solar cell. If the watch is switched between the standard mode and the power saving mode by detecting the carried state of the radio wave corrected watch, the power of the primary battery can be saved.

The other embodiments of the present invention will now be discussed.

A first alternate embodiment relates to a control program for a computer which is contained in a time measurement device which includes power generating means that generates power in response to energy coming in from the outside, power storage means for storing the power from the power generating means, receiving means for receiving a radio wave bearing time information, and time display means for displaying the current time, wherein the control program causes the computer to operate as current time information storage means for counting current time, as power detecting means which outputs a power detection signal when the power detecting means detects a power generating state of the power generating means or detects a state that a voltage stored in the power storage means is at a predetermined voltage, and as operation mode switching means which switches, in response to the power detection signal output from the power detecting means, between a power saving mode in which the time display means is maintained in a suspended state and a standard mode in which the time display means is maintained in an active state, and causes the time display means to display the current time based on the time information counted by the current time information storage means and the time information received by the receiving means when the device is switched from the power saving mode to the standard mode.

A second alternate embodiment relates to a control program for a computer which is contained in a time measurement device which includes a power source, receiving means for receiving a radio wave bearing time information, and time display means for displaying the current time, wherein the control program causes the computer to operate as current time information storage means for counting current time, as carried-state detecting means which detects a carried state of the time measurement device and outputs a carried-state detection signal, and as operation mode switching means which switches, in response to the carried-state detection signal output from the carried-signal detecting means, between a power saving mode in which the time display means is maintained in a suspended state and a standard mode in which the time display means is maintained in an active state, and causes the time display means to display the current time based on the time information counted by the current time information storage means and the time information received by the receiving means when the device is switched from the power saving mode to the standard mode.

A third alternate embodiment relates to a control program according to one of the first and second alternate embodiments, wherein when the device is switched from the power saving mode to the standard mode, the operation mode switching means causes first the receiving means to receive the time information, causes the time display means to display the current time in the current time information storage means corrected based on the time information if the receiving means has successfully received the time information, and causes the time display means to display the current time counted by the current time information storage means if the receiving means has failed to receive the time information.

A fourth alternate embodiment relates to a computer program according to one of the first or second embodiment, wherein when the device is switched from the power saving mode to the standard mode, the operation mode switching means causes first the time display means to display the current time counted by the current time information storage means, and then, corrects the current time, displayed by the time display means, in accordance with the time information received by the receiving means.

A fifth alternate embodiment relates to a computer program according to one of the first or second embodiment, wherein the current time information storage means comprises a second-of-time counter for counting the second of the current time and an hour-and-minute-of-time counter for counting the hour and minute of the current time, and wherein when the device is switched from the power saving mode to the standard mode, the operation mode switching means causes the time display means to display the hour and minute counted by the hour-and-minute-of-time counter, while correcting the second of the second-of-time counter in accordance with the time information received by the receiving means to cause the time display means to display the corrected second of the time.

A sixth alternate embodiment relates to a computer readable storage medium storing a control program for a computer which is contained in a time measurement device which includes power generating means that generates power in response to energy coming in from the outside, power storage means for storing the power from the power generating means, receiving means for receiving a radio wave bearing time information, and time display means for displaying the current time, wherein the control program causes the computer to operate as current time information storage means for counting current time, as power detecting means which outputs a power detection signal when the power detecting means detects a power generating state of the power generating means or detects a state that a voltage stored in the power storage means is at a predetermined voltage, and as operation mode switching means which switches, in response to the power detection signal output from the power detecting means, between a power saving mode in which the time display means is maintained in a suspended state and a standard mode in which the time display means is maintained in an active state, and causes the time display means to display the current time based on the time information counted by the current time information storage means and the time information received by the receiving means when the device is switched from the power saving mode to the standard mode.

A seventh alternate embodiment relates to a computer readable storage medium storing a control program for a computer which is contained in a time measurement device which includes a power source, receiving means for receiving a radio wave bearing time information, and time display means for displaying the current time, wherein the control program causes the computer to operate as current time information storage means for counting current time, as carried-state detecting means which detects a carried state of the time measurement device and outputs the carried-state detection signal, and as operation mode switching means which switches, in response to the carried-state detection signal output from the carried-signal detecting means, between a power saving mode in which the time display means is maintained in a suspended state and a standard mode in which the time display means is maintained in an active state, and causes the time display means to display the current time based on the time information counted by the current time information storage means and the time information received by the receiving means when the device is switched from the power saving mode to the standard mode.

An eighth alternate embodiment relates to a computer readable storage medium according to the sixth and seven alternate embodiments, wherein when the device is switched from the power saving mode to the standard mode, the operation mode switching means causes first the receiving means to receive the time information, causes the time display means to display the current time in the current time information storage means corrected based on the time information if the receiving means has successfully received the time information, and causes the time display means to display the current time counted by the current time information storage means if the receiving means has failed to receive the time information.

A ninth alternate embodiment relates to a computer readable storage medium according to one of the sixth or seventh embodiment, wherein when the device is switched from the power saving mode to the standard mode, the operation mode switching means causes first the time display means to display the current time counted by the current time information storage means, and then, corrects the current time, displayed by the time display means, in accordance with the time information received by the receiving means.

A tenth alternate embodiment relates to a computer readable storage medium according to one of the sixth or seventh embodiment, wherein the current time information storage means comprises a second-of-time counter for counting the second of the current time and an hour-and-minute-of-time counter for counting the hour and minute of the current time, wherein when the device is switched from the power saving mode to the standard mode, the operation mode switching means causes the time display means to display the hour and minute counted by the hour-and-minute-of-time counter, while correcting the second of the second-of-time counter in accordance with the time information received by the receiving means to cause the time display means to display the corrected second of the time.

[Advantages]

In accordance with the present invention, the time measurement device and the control method of the time measurement device have the function of power saving and the function of receiving the radio wave bearing the time information, and also provides an excellent advantage of quickly displaying current time.

While the invention has been described in conjunction with several specific embodiments, it is evident to those skilled in the art that many further alternatives, modifications and variations will be apparent in light of the foregoing description. Thus, the invention described herein is intended to embrace all such alternatives, modifications, applications and variations as may fall within the spirit and scope of the appended claims.

What is claimed is:

1. A time measurement device, comprising:

power generating means for generating power from energy coming in from the outside;

power storage means for storing the power generated by the power generating means;

current time information storage means for counting the passage of time;

receiving means for receiving a radio wave bearing time information;

time display means for displaying the current time;

power detecting means for outputting a power detection signal when the power generating means is in a power generating state or when the magnitude of a voltage stored in the power storage means is not less than a predetermined voltage magnitude; and operation mode switching means for switching, in response to the power detection signal output from the power detecting means, between a power saving mode in which the time display means is maintained in a suspended state and a standard mode in which the time display means is maintained in an active state;

wherein in response to the device being switched from the power saving mode to the standard mode, the operation mode switching means causes the receiving means to receive the time information and causes the time display means to display the current time based on the time information counted by the current time information storage means and the time information received by the receiving means.

2. A time measurement device according to claim 1, wherein when the device is switched from the power saving mode to the standard mode, if the receiving means has successfully received time information, then causes the time display means to display the current time based on the received time information and corrects the current time value in the current time information storage means based on the received time information if necessary; and if the receiving means failed to receive the time information, then causes the time display means to display the current time based on the time value counted by the current time information storage means.

3. A time measurement device according to claim 1, wherein when the device is switched from the power saving mode to the standard mode, the operation mode switching means first causes the time display means to display the current time counted by the current time information storage means; and then corrects the current time displayed by the time display means in accordance with the time information received by the receiving means.

4. A time measurement device according to claim 1, wherein the current time information storage means includes a seconds-of-time counter for counting the seconds of the current time and an hours-and-minutes-of-time counter for counting the hours and minutes of the current time; and wherein when the device is switched from the power saving mode to the standard mode, the operation mode switching means causes the time display means to display the uncorrected hours and minutes counted by the hours-and-minutes-of-time counter, while correcting the seconds value of the seconds-of-time counter in accordance with the time information received by the receiving means to cause the time display means to display the corrected seconds of the time and the uncorrected hours and minutes of the time.

5. A time measurement device comprising: a power source;

current time information storage means for counting the passage of time;

receiving means for receiving a radio wave bearing time information;

time display means for displaying the current time;

carried-state detecting means for detecting a carried state in which the time measurement device is being carried state, and operation mode switching means for switching, in response to the carried-state detect signal output from the carried-state detecting means, between a power saving mode in which the time display means is maintained in a suspended state and a standard mode in which the time display means is maintained in an active state;

wherein in response to the device being switched from the power saving mode to the standard mode, the operation mode switching means causes the receiving means to receive the time information and causes the time display means to display the current time information and causes the time display current time information storage means and the time information received by the receiving means.

6. A time measurement device according to claim 5, wherein when the device is switch from the power saving mode to the standard mode; and if the receiving means has successfully received time information, then causes the current time value in the current time information storage means to be corrected based on the received time information, and causes time display means to display the corrected current time in the current time information storage means; and if the receiving means failed to receive the time information, then causes the time display means to display the current time based on the time value counted by the current time information storage means without correcting the current time value in the current time information storage means.

7. A time measurement device according to claim 5, wherein when the device is switched from the power saving mode to the standard mode, the operation mode switching means first causes the time display means to display the current time counted by the current time information storage means; and then corrects the current time displayed by the time display means in accordance with the time information received by the receiving means.

8. A time measurement device according to claim 5, wherein the current time information storage means includes a seconds-of-time counter for counting the seconds of the current time and an hours-and-minutes-of-time counter for counting the hours and minutes of the current time; and wherein when the device is switched from the power saving mode to the standard mode, the operation mode switching means causes the time display means to display the uncorrected hours and minutes counted by the hours-and-minutes-of-time counter, while correcting the seconds value of the seconds-of-time counter in accordance with the time information received by the receiving means to cause the time display means to display the corrected seconds of the time and the uncorrected hours and minutes of the time.

9. A control method for controlling a time measurement device, comprising:

a power generating step of generating power from energy coming in from the outside;

a power storage step of storing the power generated in the power generating step;

a current time information storage step of counting the passage of time;

a receiving step of receiving a radio wave bearing time information;

a time display step of displaying the current time;

a power detecting step of outputting a power detection signal when the power generating step is active or when the magnitude of a voltage stored in the power storage step is not less than a predetermined voltage magnitude; and an operation mode switching step of switching, in response to the power detection signal output in the power detecting step, between a power saving mode in which the time display step is maintained in a suspended state and a standard mode in which the time display step is maintained in an active state;

wherein in response to the device being switched from the power saving mode to the standard mode, the operation mode switching step causes the receiving step to be performed and causes the current time to be displayed in the time display step, based on the time information counted in the current time information storage step and the time information received in the receiving step.

10. A control method for controlling a time measurement device according to claim 9, wherein when the device is switched from the power saving mode to the standard mode, if time information is successfully received in the receiving step, then causes the current time value in the current time information storage step to be corrected based on the received time information, and causes the corrected current time to be displayed in the time display step, and if time information is not successfully received in the receiving step, then causes the current time counted in the current time information storage step to be displayed in the time display step without correcting the current time value in the current time information storage step.

11. A control method for controlling a time measurement device according to claim 9, wherein when the device is switched from the power saving mode to the standard mode, the operation mode switching step first causes the current time counted in the current time information storage step to be displayed in the time display step; and then corrects the current time displayed in the time display step in accordance with the time information received in the receiving step.

12. A control method for controlling a time measurement device according to claim 9, wherein the current time information storage step includes a seconds-of-time counting sub-step of counting the seconds of the current time and an hours-and-minutes-of-time counting sub-step of counting the hours and minutes of the current time; and wherein when the device is switched from the power saving mode to the standard mode, the operation mode switching step causes the uncorrected hours and minutes counted in the hours-and-minutes-of-time counting sub-step to be displayed in the time display step, while correcting the seconds value in the seconds-of-time counting sub-step in accordance with the time information received in the receiving step to cause the corrected seconds of the time and the uncorrected minutes and hours of the time to be displayed in the time display step.

13. A control method for controlling a time measurement device having a power source, comprising;

a current time information storage step of counting the passage of time;

a receiving step of receiving a radio wave bearing time information;

a time display step of displaying the current time;

a carried-state detecting step of detecting a carried state in which the time measurement device is being carried and outputting a carried-state detection signal in response to detection of said carried state, and an operation mode switching step of switching, in response to the carried-state detection signal output in the carried-state detecting step, between a power saving mode in which the time display step is maintained in a suspended state and a standard mode in which the time display step is maintained in an active state;

wherein in response to the device being switched from the power saving mode to the standard mode, the operation mode switching step causes the receiving step to be performed and causes the current time to be displayed in the time display step, based on the time information counted in the current time information storage step and the time information received in the receiving step.

14. A control method for controlling a time measurement device according to claim 13, wherein when the device is switched from the power saving mode to the standard mode, if time information is successfully received in the receiving step, then causes the current time value in the current time information storage step to be corrected based on the received time information, and causes the corrected current time to be displayed in the time display step, and if time information is not successfully received in the receiving step, then causes the current time counted in the current time information storage step to be displayed in the time display step without correcting the current time value in the current time information storage step.

15. A control method for controlling a time measurement device according to claim 13, wherein when the device is switched from the power saving mode to the standard mode, the operation mode switching step first causes the current time counted in the current time information storage step to be displayed in the time display step; and then corrects the current time displayed in the time display step in accordance with the time information received in the receiving step.

16. A control method for controlling a time measurement device according to claim 13, wherein the current time information storage step includes a seconds-of-time counting sub-step of counting the seconds of the current time and an hours-and-minutes-of-time counting sub-step of counting the hours and minutes of the current time; and wherein when the device is switched from the power saving mode to the standard mode, the operation mode switching step causes the uncorrected hours and minutes counted in the hours-and-minutes-of-time counting sub-step to be displayed in the time display step, while correcting the seconds value in the seconds-of-time counting sub-step in accordance with the time information received in the receiving step to cause the corrected seconds of the time and the uncorrected hours and minutes of the time to be displayed in the time display step.

17. A time measurement device, comprising:

a power generator for generating power from energy coming in from the outside;

a power store coupled to store the power generated by the power generator;

a current-time-information tracker for tracking the passage of time;

a receiver coupled to receive a radio wave bearing time information;

a time display for displaying the current times a power detector for outputting a power detection signal when the power generator is in a power generating state or when the magnitude of a voltage stored in the power store is not less than a predetermined voltage magnitude; and an operation mode switcher for switching, in response to the power detection signal output from the power detector, between a power saving mode in which the time display is maintained in a suspended state and a standard mode in which the time display is maintained in an active state, wherein in response to the device being switched from the power saving mode to the standard mode, the operation mode switcher causes the receiver to receive the time information and causes the time display to display the current time based on the time information tracked by the current-time-information tracker and the time information received by the receiver.

18. A time measurement device according to claim 17, wherein when the device is switched from the power saving mode to the standard mode, if the receiver has successfully received time information, then causes the time display to display the current time based on the received time information and corrects the current time value in the current-time-information tracker based on the received time information if necessary; and if the receiver failed to receive the time information, then causes the time display to display the current time based on the time value tracked by the current-time-information tracker.

19. A time measurement device according to claim 17, wherein when the device is switched from the power saving mode to the standard mode, the operation mode switcher first causes the time display to display the current time tracked by the current-time-information tracker; and then corrects the current time displayed by the time display in accordance with the time information received by the receiver.

20. A time measurement device according to claim 17, wherein the current-time-information tracker includes a seconds-of-time counter for counting the seconds of the current time and an hours-and-minutes-of-time counter for counting the hours and minutes of the current time; and wherein when the device is switched from the power saving mode to the standard mode, the operation mode switcher causes the time display to display the uncorrected hours and minutes counted by the hours-and-minutes-of-time counter, while correcting the seconds value of the seconds-of-time counter in accordance with the time information received by the receiver to cause the time display to display the corrected seconds of the time and the uncorrected minutes and hours of time.

21. A time measurement device comprising:

a power source;

a current-time-information tracker for tracking the passage of time;

a receiver for receiving a radio wave bearing time information;

a time display for displaying the current time;

a carried-state detector for detecting a carried state in which the time measurement device is being carried and outputting a carried-state detection signal in response to detection of said carried state, and an operation mode switcher for switching, in response to the carried-state detection signal output from the carried-state detector, between a power saving mode in which the time display is maintained in a suspended state and a standard mode in which the time display is maintained in an active state;

wherein in response to the device being switched from the cower saving mode to the standard mode, the operation mode switcher causes the receiver to receive the time information and causes the time display to display the current time based on the time information tracked by the current-time-information tracker and the time information received by the receiver.

22. A time measurement device according to claim 21, wherein when the device is switched from the power saving mode to the standard mode, if the receiver successfully receives time information, then causes the current time value in the current-time-information tracker to be corrected based on the received time information, and causes the time display to display the corrected current time from the current-time-information tracker; and if the receiver fails to successfully receive the time information, then causes the time display to display the current time based on the time value tracked by the current-time-information tracker without correcting the current time value in the current time information tracker.

23. A time measurement device according to claim 21, wherein when the device is switched from the power saving mode to the standard mode, the operation mode switcher first causes the time display to display the current time tracked by the current-time-information tracker; and then corrects the current time displayed by the time display in accordance with the time information received by the receiver.

24. A time measurement device according to claim 21, wherein the current-time-information tracker includes a seconds-of-time counter for counting the seconds of the current time and an hours-and-minutes-of-time counter for counting the hours and minutes of the current time; and wherein when the device is switched from the power saving mode to the standard mode, the operation mode switcher causes the time display to display the uncorrected hours and minutes counted by the hours-and-minutes-of-time counter, while correcting the seconds value of the seconds-of-time counter in accordance with the time information received by the receiver to cause the time display to display the corrected seconds of the time and the uncorrected minutes and hours of the time.

* * * * *